United States Patent [19]

Conn et al.

[11] Patent Number: 4,716,849

[45] Date of Patent: Jan. 5, 1988

[54] EROSIVE-JET DIVER TOOL

[75] Inventors: Andrew F. Conn, Baltimore; Virgil E. Johnson, Jr., Gaithersburg, both of Md.

[73] Assignee: Tracor Hydronautics, Inc., Laurel, Md.

[21] Appl. No.: 739,535

[22] Filed: May 31, 1985

[51] Int. Cl.[4] ..... B63B 59/00

[52] U.S. Cl. ..... 114/222; 440/38; 239/144; 239/419.5; 239/526; 299/17; 134/167 R

[58] Field of Search ..... 114/222; 440/67, 38; 239/124, 436, 101, 142, 419.5, 526; 299/17; 405/73; 175/5-10, 67; 134/167 R, 167 C; 51/317-321, 410

[56] References Cited

U.S. PATENT DOCUMENTS

| | | | |
|---|---|---|---|
| 2,720,390 | 10/1955 | Brooks | 299/17 |
| 3,251,331 | 5/1966 | Crawford | 114/222 |
| 3,536,263 | 10/1970 | Parker | 134/167 C |
| 3,580,511 | 5/1971 | Hammelman | 134/167 R |
| 3,885,739 | 5/1975 | Tuttle | 239/124 |
| 4,074,652 | 2/1978 | Jackson | 440/67 |
| 4,389,071 | 6/1983 | Johnson, Jr. et al. | 175/67 |

OTHER PUBLICATIONS

"The Zero Thrust Gun", Marine Engineering/Log International, Feb. 1978, p. 59.

*Primary Examiner*—Jeffrey V. Nase
*Assistant Examiner*—Jesûs D. Sotelo
*Attorney, Agent, or Firm*—Finnegan, Henderson, Farabow, Garrett & Dunner

[57] ABSTRACT

An erosive fluid jet tool for underwater operation, comprising an erosive fluid jet nozzle connected to a fluid receiver receiving fluid under elevated pressure for providing hydraulic power to the tool, the nozzle providing the working output jet of the tool; and a counterthruster for providing a counterthrusting force for balancing the thrust on the tool produced by the erosive fluid jet, the counterthruster including (a) a counterthrusting fluid jet nozzle connected to the fluid receiver and facing oppositely to the erosive nozzle for providing a counterthrusting jet, and (b) an open ended shroud coaxially surrounding the counterthrusting nozzle, whereby water surrounding the submerged tool is entrained through the shroud for providing additional counterthrusting force during operation of the counterthrusting nozzle, the erosive fluid jet nozzle and the counterthruster being constructed so that in excess of 50% of the hydraulic power provided to the tool is provided to the erosive fluid jet nozzle.

40 Claims, 14 Drawing Figures

EROSIVE-JET DIVER TOOL

BACKGROUND OF THE INVENTION

The present invention relates to diver-operated tools, and more particularly, to diver-operated tools using water jets to erode submerged articles. Such tools are used for a variety of applications, including removing marine growths from surfaces so as to permit either inspection or repairs; stripping off concrete "weight-coats" from underwater steel pipelines which contain gas or oil to allow for repair or modification of these pipelines; and stripping off coal-tar based protective paint coatings from steel members, again to permit repair of modification. Conventional water jet diver-operated tools typically provide some means for countering the thrust force exerted by the erosive jet on the front end of the tools. Without this counterthrust means, the diver would be continually forced backwards in the water by the thrust of the erosive jet, and would thus have to exert considerable wasted energy in order to maintain his desired working position.

Conventional diver-operated water jet tools merely divert fifty percent of the water flow available to the tool through a counterthrusting water jet nozzle affixed to the back end of the tool. This counterthrusting water jet-forming nozzle thus develops a force which is equal to magnitude but opposite in direction to the force created by the erosive water jet on the front end of the tool. In this manner, the tool attains a force balance, and hence can be more easily deployed by the diver.

In such conventional water jet tools, fully one-half of the available hydraulic power (from the high-pressure pump used to feed the water to the tool) is thus not being used for performing the work intended, namely cleaning or cutting a substance with the erosive jet.

The nozzles used to form the erosive jet in conventional diver tools are not designed to create cavitation in an effective fashion. Nozzles designed to create effective cavitation have proven to be capable of much more rapid and efficient cleaning and cutting when compared to conventional nozzles delivering the same flow rate with an equal pressure drop across the nozzles.

Because of the considerable expense involved in performing underwater work with a team of divers, it is very desirable to provide the divers with the most efficient and effective tools possible, within economic boundaries. Although one alternative for increasing the cleaning or cutting effectiveness of underwater erosive water jet tools is to purchase and operate pumps which produce larger flow rates of water at higher pressures, such higher capacity pumps are increasingly expensive to purchase and operate. However, higher flow rates require larger, more expensive, and unwieldy hoses to transfer the water from the pump to the diver-operated cool. Furthermore, despite careful balancing, there are limits to the amount of total power that a diver can safely handle. Although higher pressure (than the conventional 10,000 psi commonly used with diver tools) will increase cleaning the cutting rates, there are many drawbacks to this approach, which include: greater danger if the erosive jet is misdirected or if any hoses, fittings, or pipes are broken; shorter lifetimes for all system components, including nozzles, hoses, pump seals, and packings; and greater expense in the purchase, maintenance, and replacement of very high pressure components. Also, higher pressures require a higher horsepower for the diesel engine typically used to drive the pump, and hence a greater fuel cost for operation of the system.

It is therefore desirable to provide a water jet erosive tool for divers which can most efficiently utilize a minimized amount of hydraulic power, i.e., minimized flow rates for the water and minimized pump pressures. The present invention significantly improves the usage of available hydraulic power. It has been demonstrated in numerous comparative tests that the tool of the present invention is capable of substantially faster rates of cleaning and cutting when compared to conventional water jet diver tools.

SUMMARY OF THE INVENTION

The present invention overcomes the problems and disadvantages of the prior art by providing a diver-operated water jet tool having greatly improved rates of underwater cleaning and cutting. These improvements are accomplished in the invention by a more efficient means of creating a counterthrust balance for the tool, thus allowing a larger than conventional percentage of available hydraulic power to be directed through the erosive jet-forming nozzle. This enhanced counterthrusting capability uses a jet pump concept, which allows the counterthrusting jet to entrain large amounts of surrounding fluid and eject this fluid through the counterthruster outlet. In addition, the tool utilizes a cavitating jet nozzle which is more erosive than conventional nozzles.

In accordance with the present invention, it has been found that improved rates of performance and more efficient usage of any given amount of hydraulic power can be achieved with a diver-controlled erosive water jet tool constructed with an improved jet-pump counterthrusting apparatus. For example, using the present invention, concrete weight-coats up to 2.5 inches thick have been completely stripped off steel pipes at rates over 30 times faster than those achieved by conventional, commercial water jet diver-operated tools. Coal-tar based epoxy coatings have been removed by the present invention at rates over twelve times faster than with a conventional water jet tool. Similar results have been achieved in the removal of marine growths underwater, including heavy incrustations or barnacles and tube worms, and thick layers of marine vegetation.

Additional objects and advantages of the invention will be set forth in part in the description which follows, and in part will be obvious from the description, or may be learned by practice of the invention. The objects and advantages of the invention will be realized and attained by means of the instrumentalities and combinations particularly pointed out in the appended claims.

To achieve the objects and in accordance with the purposes of the invention, as embodied and broadly described herein, the invention comprises an erosive fluid jet tool for underwater operations, comprising: means for receiving a fluid under elevated pressure for providing hydraulic power to the tool; erosive fluid jet nozzle means connected to the fluid receiving means for providing the working output jet of the tool; and means for providing a counterthrusting force for balancing the thrust on the tool produced by the erosive fluid jet, the counterthrusting means including counterthrusting fluid jet nozzle means connected to the fluid receiving means and facing oppositely to the erosive nozzle means for providing a counterthrusting jet, and open ended shroud means coaxially surrounding the counterthrusting nozzle means, whereby water surrounding the submerged tool is entrained through the shroud means for providing additional counterthrusting force during operation of the counterthrusting nozzle means, the erosive fluid jet nozzle means and the counterthrusting means being constructed so that in excess of 50% of the hydraulic power provided to the tool is provided to the erosive fluid jet nozzle means. Preferably, the inlet contour and internal shape of the shroud means are selected to substantially reduce losses in the flow of water entrained through the shroud means. The counterthrusting means includes a counterthrusting nozzle which is shaped so as to optimize the entrainment of surrounding water, and a shroud having an intake shape and internal contour which further contribute to the entrainment action of the counterthrusting nozzle.

With an idealized, zero loss system, the theoretical efficiency of a perfect jet-pump counterthrusting device in accordance with the present invention would permit just one-third of the total fluid flow to be sent through the counterthrusting nozzle. This should be compared with fifty percent of the flow which must be sent through the counterthrusting nozzle in conventional diver-operated water jet tools. In testing the tool of the present invention, only about thirty-eight percent of the totol fluid flow was required through the counterthrusting nozzle. This was, thus, within five percent of the theoretical, idealized value, which cannot be achieved in practice due to the inherent frictional and turbulent losses in any actual fluid-dynamic system.

It is understood that both the foregoing general description and the following detailed description are exemplary and explanatory, but are not restrictive of the invention as claimed.

The accompanying drawings, which are incorporated in and constitute a part of this specification, illustrate several exemplary embodiments of the invention, and together with the description serve to explain the principles of the invention.

DESCRIPTION OF THE PREFERRED EMBODIMENTS

Reference will now be made in detail to the presently preferred embodiments of the invention, examples of which have been illustrated in the accompanying drawings.

Figures 1, 2:
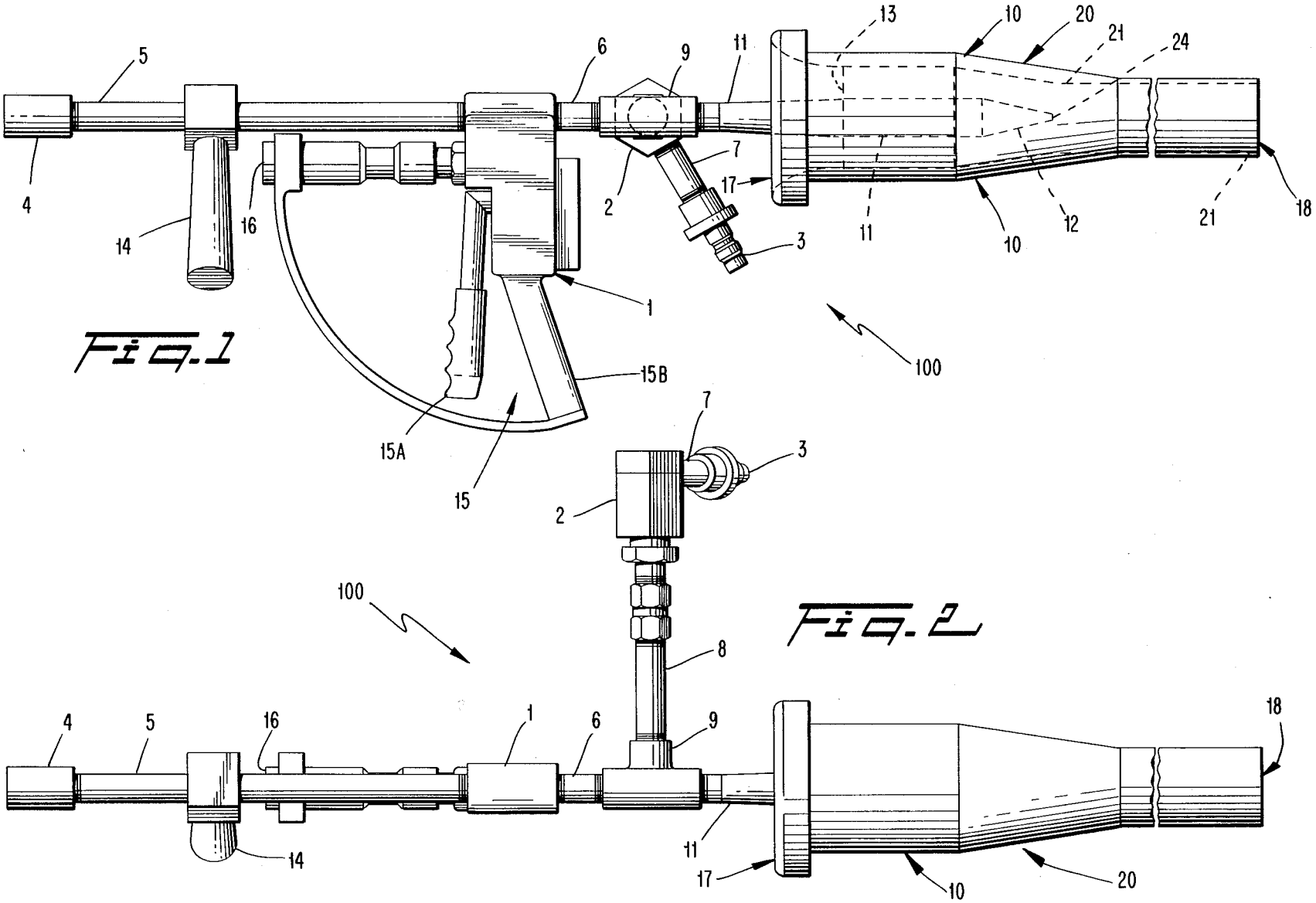
FIG. 1 is an overall side view of the diver-operated erosive water-jet tool of the present invention for cleaning and cutting materials underwater. Not shown in this figure are the high-pressure water source and the flexible high-pressure hose which connect this water source to the water-jet tool.
FIG. 2 is a top view of the tool shown in FIG. 1, showing additional details.

One preferred embodiment of the diver-operated, underwater, erosive fluid jet tool of the invention is shown in FIGS. 1 and 2, and is represented generally by the numeral 100.

Tool 100 includes means for receiving a fluid, typically water, under elevated pressure for providing hydraulic power to the tool. As embodied herein, such means for receiving a fluid includes quick disconnect 3. Water from a high-pressure source, such as a diesel engine-driven positive-displacement pump (not shown), is fed at typical flow rates of up to twenty gallons per minute through a flexible hose (not shown) capable of operation at typical pressures of up to about 10,000 pounds per square inch (psi). This hose is fastened to tool 100 via quick-disconnect 3 which allows for attachment and release of the hose to and from the tool without the use of any mechanical aids.

Tool 100 further includes erosive fluid jet nozzle means for providing the working output jet of the tool. As embodied herein, erosive fluid jet nozzle means includes nozzle 4 which, as will be discussed below, preferably comprises a cavitating fluid jet nozzle. Nozzle 4 is connected to quick disconnect 3 through short pipe segments 7 and 8 having elbow-swivel 2 therebetween, tee 9, and short pipe segment 6 and lance pipe 5 having valve 1 therebetween.

The water flows into tool 100 through short segment of pipe 7 and thence through elbow-swivel 2. This swivel allows for free movement of the tool when the pressure in the hose has caused the hose to become rather rigid. The water then continues through pipe 8 and into tee 9. Part of the flow of water then proceeds forward, in tee 9, through valve 1, lance pipe 5, and finally exits the tool through the front end mounted erosive jet-forming nozzle 4. The remainder of the flow proceeds out of the back end of tee 9, through nozzle supply pipe 11, then through counterthrusting nozzle 12 via orifice 24, and finally exits the tool through counterthruster exit orifice 18 at the back end of shroud 10.

As seen in FIG. 1, the diver can grasp handle 14 of tool 100 with his left hand and handle 15 with his right hand. Handle 15 is operatively connected to valve 1.

Squeezing handle portion 15A toward handle portion 15B will cause the flow of water which is proceeding forward from tee 9 to be routed via valve 1 to nozzle 4. Releasing handle portion 15A will allow this flow to be diverted via valve 1 so that is exits the tool through large, low-pressure dump orifice 16. This dump capability is an essential feature of any high-pressure water-jet tool. Whenever the diver releases his hand hold on handle 15, the flow is, thus, diverted via valve 1 through the large opening in dump orifice 16, which relieves the pressure in the tool.

Nozzle 4 is designed to enhance the creation of cavitation in and around the fluid jet, typically water, which issues from the nozzle. Such cavitating jet nozzles are disclosed, for example, in U.S. Pat. Nos. 3,528,704, 3,713,699, 3,807,632, 4,389,071, and 4,474,251, the disclosures of which are hereby incorporated herein by reference. The latter two patents also disclose methods and apparatus for providing passive (i.e., self-excited) fluctuation (pulsing) of the velocity of cavitating fluid jets to enhance the creation of cavitation. Such cavitating jet nozzles and cavitation enhancement techniques are preferably utilized in accordance with the invention to provide the ability to utilize more effectively the added amount of forward-flowing water afforded by the jet-pump counterthrusting device 20 (also referred to herein as the counterthruster) of the present invention.

Tool 100 also includes means for providing a counterthrusting force for balancing the thrust on the tool produced by the erosive fluid jet. As embodied herein, counterthrusting means, i.e., counterthruster 20, includes counterthrusting fluid jet nozzle means connected to the fluid receiving means and facing oppositely to erosive nozzle 4 for providing a counterthrusting jet, and open ended shroud means coaxially surrounding the counterthrusting nozzle means. Water surrounding the submerged tool is entrained through the shroud means for providing additional counterthrusting force during operation of the counterthrusting nozzle means. The erosive fluid jet nozzle means and the counterthrusting means are constructed so that in excess of 50% of the hydraulic power provided to the tool is provided to erosive fluid jet nozzle 4.

As embodied herein, the counterthrusting fluid jet nozzle means includes nozzle supply pipe 11 connected to tee 9 and nozzle 12 having an orifice 24.

As further embodied herein, the open ended shroud means coaxially surrounding the counterthrusting nozzle means includes tubular shroud 10. Shroud 10 preferably includes an entrance opening 17, an inlet portion 22 connected to opening 17 and extending to the exit plane defined by nozzle orifice 24, and a cylindrical mixing tube 21 connected to inlet portion 22 and extending downstream from such exit plane (see also section I in FIG. 9).

The exterior contours of nozzle supply pipe 11 and counterthrusting nozzle 12 of counterthruster 20 are preferably shaped so as to augment the ability of the jet issuing from orifice 24 of nozzle 12 to entrain the water present between the inside of shroud 10 and the exterior of pipe 11 (and nozzle 12) when the tool is submerged during operation. Furthermore, as will be discussed below, the shape of the entrance opening 17 into shroud 10, as well as the internal contour of shroud 10, are preferably designed to substantially reduce resistance to flow into the shroud and losses in the flow entrained through shroud 10. The foil-shaped struts 13, which connect shroud 10 to nozzle supply pipe 11, are also contoured to minimize resistance to the flow of water through the shroud.

In this manner, a maximum amount of water can be entrained by the counterthrusting jet issuing from nozzle 12 and eventually issue from counterthrusting exit orifice 18 at the downstream end of shroud 10. Thus, the total flow of fluid issuing from exit orifice 18 is a combination of that part of the original high-pressure water which proceeds out the back end of tee 9 and through nozzle 12 via orifice 24, plus the water which has been induced to flow into shroud 10 by the jet-pumping action of nozzle 12. When system losses are minimized by properly configuring counterthruster 20, as discussed below, the total momentum issuing from shroud 10 is greater than that issuing from an unshrouded counterthrusting nozzle 12. Thus, the overall counterthrust in the present invention is greater than that of conventional counterthrusters.

Conventional counterthrusted underwater diver-operated fluid jet tools obtain counterthrust by ejecting fluid flow rearward through a nozzle, the flow having an exit momentum identical to that of the forward working nozzle. Thus, the counterthrust nozzle (whose pressure drop and exit velocity is identical to the forward nozzle) must also have the same flow rate. The power required to supply this counterthrust is thus identical to that supplied to the forward nozzle. That is, fully one-half of the total hydraulic power available for cutting or cleaning is wasted in obtaining the necessary counterthrust.

In order to protect the diver from the rearward facing counterthrust flow in conventional fluid jet tools, a protective casing of large diameter is typically installed around the jet and sometimes closed off at the forward end. Holes or slots are typically provided around the casing to allow flow to enter the tube in the neighborhood of the counterthrust nozzle. No attempt has been made in conventional fluid jet tools to minimize the hydraulic energy losses associated with the flow of the surrounding fluid into the low pressure region induced by the high velocity jet exchanging its momentum with the fluid surrounding it. In such prior art tools, the holes and slots are ade large enough to achieve just the counterthrust expected from the nozzle if it were discharging into infinite surroundings.

The art has not recognized that the thrust of a counterthrusting jet in a diver-operated erosive fluid jet tool can theoretically be nearly doubled if it is surrounded by a shroud 10 open only at its upstream and downstream ends, provided the upstream open end is designed so as to substantially minimize the hydraulic losses of the entering flow induced by the jet.

The portion of shroud 10 extending downstream of nozzle 12 forms, at its interior surface, a mixing tube 21 for mixing the flow exiting from orifice 24 with the surrounding entrained flow in shroud 10 prior to the combined flow exiting the shroud via exit orifice 18.

We have discovered that optimum thrust augmentation cannot be realized if the ratio of the surrounding mixing tube 21 diameter to the counterthrust jet orifice 24 diameter is not large enough to make the ratio of counterthrust jet flow rate to entrained flow rate small compared with unity, and also large enough to prevent cavitation from occurring to any great extent over the interior of the surrounding tube 21.

We have also found that additional decreases in performance will result if the wall thickness of the material comprising nozzle 12, which confines the jet in the exit plane of the jet and in its upstream neighborhood is not minimized and if the length and diameter of the mixing tube are not selected so as to minimize friction force while still obtaining adequate mixing and thus a nearly uniform flow out the exit of the surrounding tube.

Figure 8:
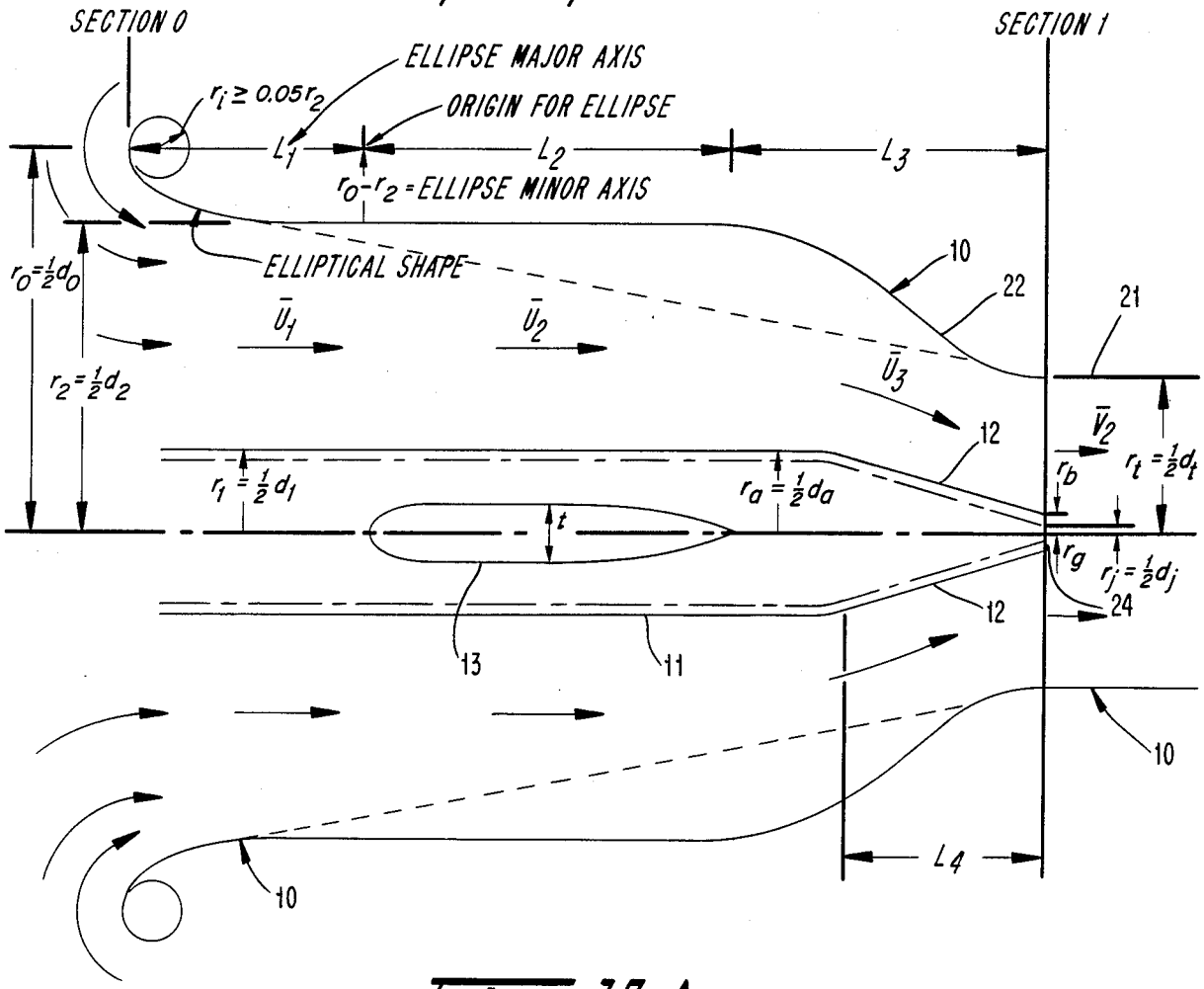
FIG. 8 is a schematic view illustrating geometric details of the inlet portion of the counterthrusting device of the present invention, as well as symbols for the geometric lengths and velocities pertinent to this device.
Figure 12A:
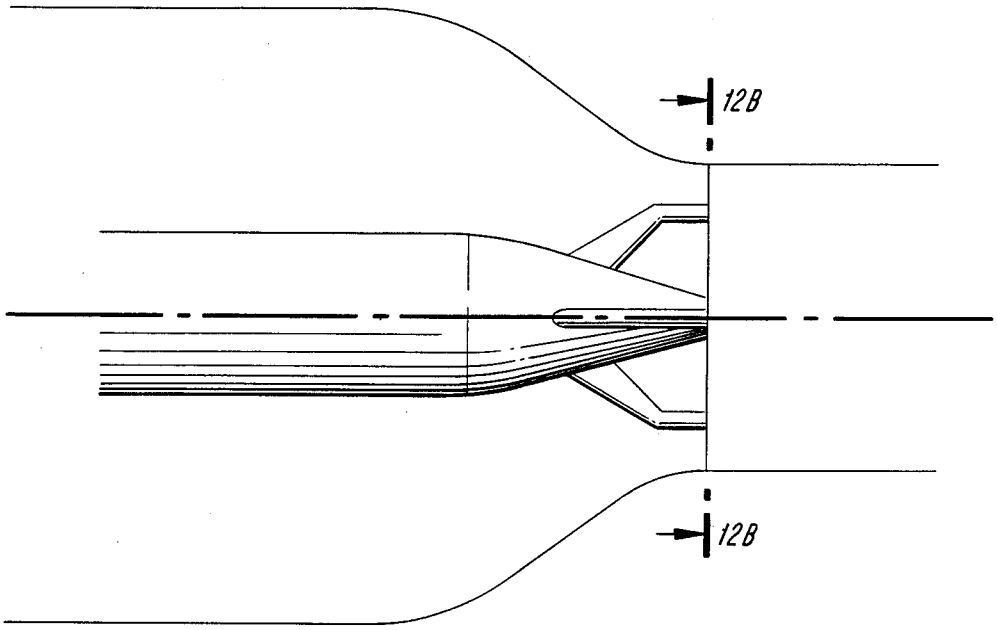
Figures 9, 10:
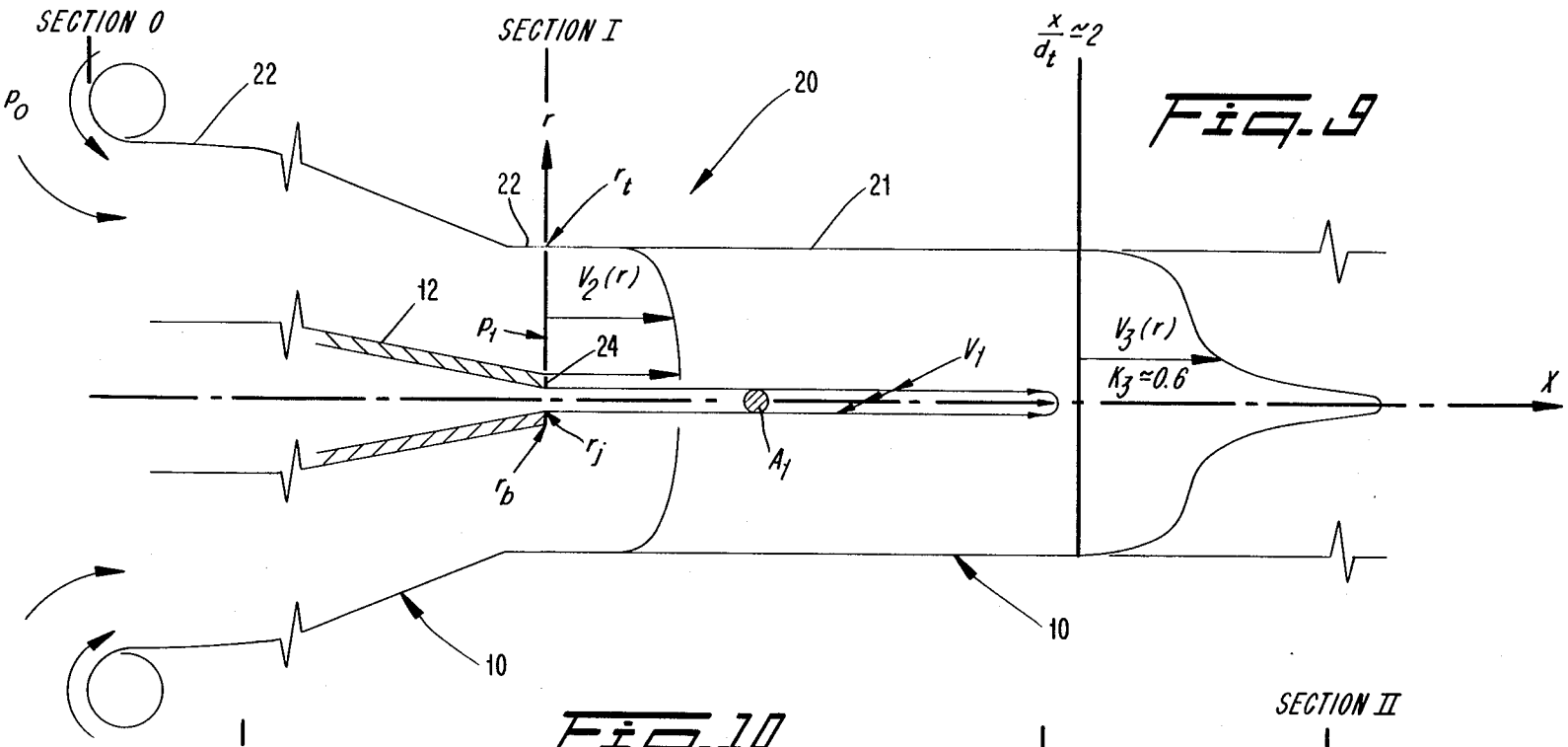
FIG. 9 is a schematic diagram of the upstream portion of the mixing tube segment of the jet-pump counterthrusting device of the present invention showing symbols for geometric lengths and velocities pertinent to the mixing tube, as well as the approximate radial distribution of velocity at the counterthrust nozzle ($x/d_t=0$) and at $x/d_t=2$.
FIG. 10 shows later distributions of velocity near the midlength of the mixing tube ($x/d_t=5$) and at the $x/d_t=9$ and 10 points of the mixing tube.

In FIGS. 8 and 9, entrained flow enters counterthruster 20 at cross-section O and accelerates to cross-section I where its average velocity is denoted as $\overline{V}_2$ (such that $\overline{V}_2A_2$=discharge) and the mean pressure at section I is denoted as $P_1$. The actual velocity distribution $V_2(r)$ entering section I is approximately as shown in FIG. 9. The annular area $A_2$ associated with $V_2$ is $\pi(r_t^2-r_b^2)$, where $r_t$ is the radius of the interior surface of mixing tube 21 and $r_b$ is the external radius of orifice 24 of nozzle 12 at the exit plane. At cross-section I, flow from counterthrust nozzle 12 is emitted at average velocity $\overline{V}_1$ through the nozzle orifice area $A_1=\pi r_j^2$, where $r_j$ is the internal radius of orifice 24 (i.e., the radius of the jet exiting from nozzle orifice 24). Downstream of cross-section I the two flows exchange momentum such that the velocity distribution $V_3(r)$ at any station X along the length of counterthruster mixing tube 21, although initially highly non-uniform, progresses to a nearly uniform velocity distribution across the surrounding tube area when x reaches the downstream end of mixing tube 21 ($x=L_t$=length of tube 21).

We have found that nearly complete mixing is achieved when $L_t=10d_t$, where $d_t$ is the interior diameter of mixing tube 21. For $L_t$–$10d_t$, the velocity distribution V(r) does not change significantly with further increase in $L_t$. However, further increases in $L_t$ will increase the surface area and thus cause an increase in friction drag, F, on mixing tube 21 which will decrease the thrust of counterthruster 20. The preferred length, $L_t$, of mixing tube 21 of counterthruster shroud 10 is 9 $d_t$, based on the tradeoff between the increasing losses due to frictional drag (F) as $L_t/d_t$ increases, versus the increasing uniformity of the velocity distribution as $L_t$ increases to 10 $d_t$. We have determined that the best performance occurs at a value of $L_t$ for which the flow is not quite fully developed, i.e., less than $L_t=10d_t$. The invention also contemplates a tool wherein the value of the ratio $L_t/d_t$ is greater than about 6 and less than about 15.

In calculating the thrust produced by counterthruster 20 shown in FIGS. 8, 9 and 10, the total force acting on the control volume within mixing tube 21 between cross-section I at the exit plane defined by orifice 24 and cross-section II at the exit plane 18 of counterthruster 20 is known to be equal to the time rate of change of momentum. Next, considering the momentum equation for a large cylindrical control volume whose radius is much larger than $r_o$ (FIGS. 8 and 9), and whose upstream section is considerably upstream of section O (FIGS. 8 and 9), but not enclosing the erosive nozzle 4, and whose downstream section remains at the counterthruster mixing tube exit 18, then it can be shown that the total thrust ($T_c$) developed by counterthruster 20 is given by the following equation:

$$T_c=K_3\rho A_3\overline{V}_3^2$$

where $K_3$ is a momentum coefficient associated with $\overline{V}_3$ and $A_3$, and where $\overline{V}_3$ is the flow velocity at section II, $A_3=A_1+A_2+a_b$, and $a_b=\rho(r_b^2-r_j^2)$.

Since the thrust of the primary jet driving the counterthrust system is $T_p=K_1\rho A_1C_{o1}V_1^2$, where $K_1$ is a momentum coefficient associated with $V_1$ and $A_1$, and where $C_{o1}$=the counterthrust nozzle (12) discharge coefficient, we may define the thrust augmentation ratio, $C_T$, as follows:

$$C_T=\frac{T_c}{T_p}=\left(\frac{1}{C_{o1}}\right)\left(\frac{K_3}{K_1}\right)\left(\frac{A_3}{A_1}\right)\left(\frac{\overline{V}_3}{\overline{V}_1}\right)^2$$

where $C_{o1}$, the counterthrust nozzle discharge coefficient, is approximately equal to one.

In ascertaining the preferred value of $C_T$ for practical diver-operated tools, we have determined that $A_3/A_1$ and $\overline{V}_3A_3/\overline{V}_1A_1$ should be much greater than 1 for best performance. Preferably, as will be shown subsequently, $A_3/A_1$ will be equal to or greater than about $2.62\Delta P/Po$ and $\overline{V}_3A_3/\overline{V}_1A_1$ will be equal to or greater than about $1.3\sqrt{A_3/A_1}$. Practical diver tools will preferably have $\Delta P\geqq$about 5,000 psi and $Po\geqq$about 14 psi, so that $\Delta P/Po\geqq$about 357, and thus $A_3/A_1\geqq$about 935 and $\overline{V}_3A_3/\overline{V}_1A_1\geqq$about 25. Consequently, both $A_3/A_1$ and $\overline{V}_3A_3/\overline{V}_1A_1$ are preferably much greater than 1, so that the preceding equation may be expressed approximately as:

$$C_T=\frac{2}{2\left(\frac{K_2}{K_3}-1\right)+4c_f\frac{K_1}{K_3}\frac{L_t}{d_t}+\left(\frac{K_2^*}{K_3}\right)(1+k_L)}$$

where $K_2$ is a momentum coefficient associated with $\overline{V}_2$ and $A_2$; $K_2^*$ is an energy coefficient similar to $K_2$ associated with $\overline{V}_2$ and $A_2$; $c_f$ is a friction coefficient associated with mixing tube 21; and $k_L$ is a pressure loss coefficient defined by the following equation:

$$k_L=\frac{P_L}{K_2^*\frac{1}{2}\rho\overline{V}_2^2}$$

$P_L$ being the pressure loss between sections O and I.

For the hypothetically ideal case, if all of the K coefficients are unity (i.e., if the velocity V(r) is uniform), and if $K_2^*$ is unity and $c_f$ and $k_L=0$ (i.e., no losses), then for this ideal case $$C_{T\,ideal}\approx 2$$

Furthermore, as $L_t/d_t$ approaches ten, $K_3$ approaches one; that is, the velocity distribution at cross-section II is nearly that of fully developed turbulent pipe flow. The values of $K_2$ and $K_2^*$ will also be approximately 1 if the inlet portion 22 (sections O to I) of counterthruster shroud 10 is well streamlined and without flow separation throughout its length. As will be discussed below, this inlet portion is preferably designed in accordance with the present invention so as to achieve such a flow. Consequently, it may be assumed that $K_2$, $K_2^*$, and $K_3$ are approximately equal to 1.

For the case where $K_2=K_2^*=K_3=1.0$, $L_t=9d_t$, $A_3/A_1>1$ and $\overline{V}_3A_3/\overline{V}_1A_1>1$, the expression for $C_T$ then becomes approximately:

$$C_T\simeq\frac{2}{1+k_l+4c_f\frac{L_t}{d_t}}$$

In the immediately preceding equation, the ideal case of $k_L=O$ will be approached if the cross-sectional area $A_1$ of entrance opening 17 (section O) of inlet portion 22 is very much greater than the cross-sectional area of counterthrust mixing tube 21, i.e., $A_3$, as discussed previously. However, the term $4c_fL_t/d_t$ can approach zero only if the value of $L_t/d_t$ required for complete mixing can be reduced below the value of about 9 which, as shown above, is required for the embodiments of the invention discussed heretofore.

Figure 12B:
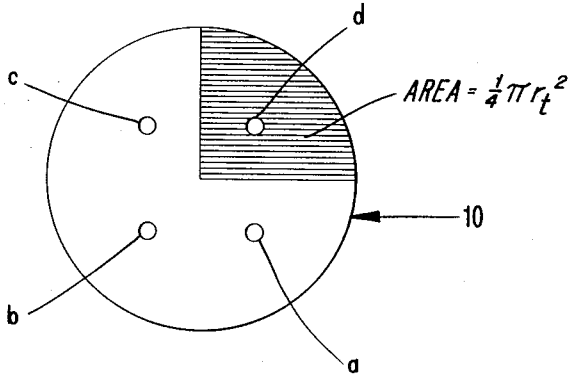
FIGS. 12A and 12B shows a multiple-orifice counterthrusting device for use in a diver-operated water jet tool in accordance with a further embodiment of the invention.
Figure 4:
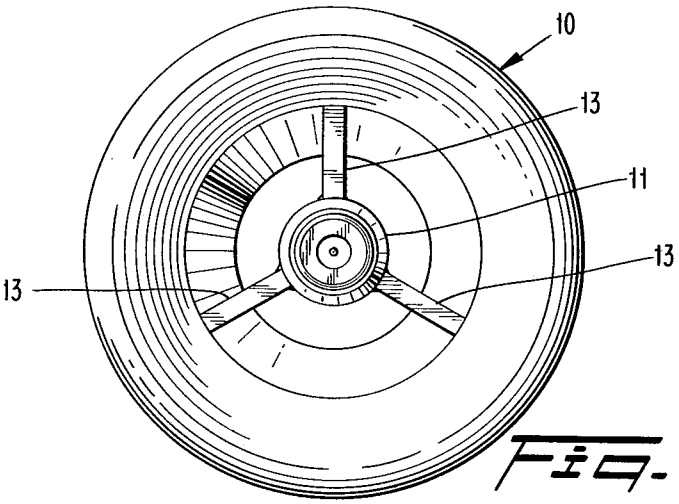
FIG. 4 is a front view of the shroud shown in FIG. 3.
Figure 5:
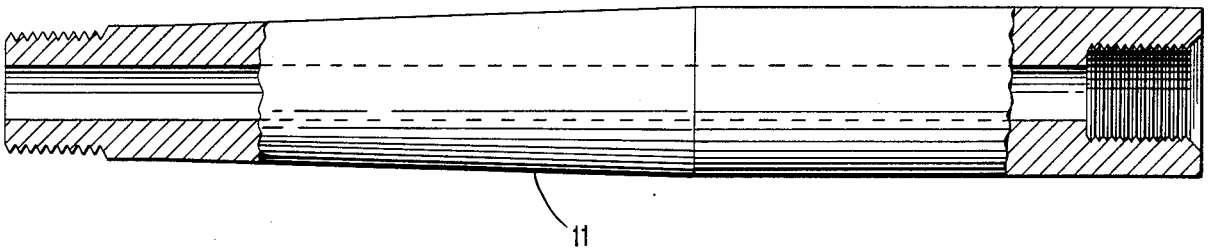
FIG. 5 is a side view, in partial cross section, of the nozzle supply pipe which connects the counterthrusting nozzle shown in FIGS. 3 and 6 to the tool.
Figure 6:
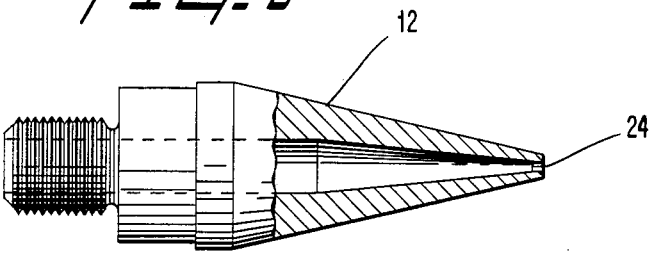
FIG. 6 is a side view, in partial cross section, of a counterthrusting nozzle suitable for use in the jet-pump counterthrusting device of the present invention.
Figure 7B:
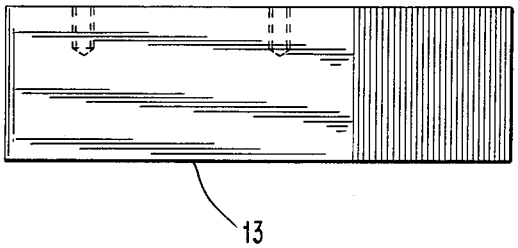
FIGS. 7A and 7B show views of the top and side, respectively, of one of the three foil-shaped struts which are suitable for connecting the shroud shown in FIG. 3 to the nozzle supply pipe shown in FIG. 5.
Figure 7A:
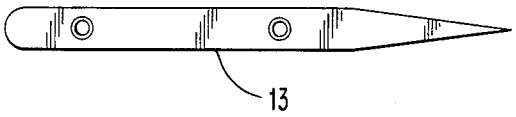

The value of $L_td_t$ can, however, be reduced in an alternate embodiment of the invention if the primary orifice jet flow is ejected through multiple nozzles 12a to 12n (FIG. 12B) instead of a single nozzle 12. That is, the preferred mixing length in connection with this embodiment can be expressed as $(L_t/d_t)\approx 9n^{-\frac{1}{2}}$ where n is the number of nozzles located at the centroid of each of $A_3/_n$ equal areas at section I. Then, the maximum achievable value of $C_T$ will be approximately $2/(1+36c_fn^{-\frac{1}{2}})$ or, for $c_f=0.003$ and $n=1$, $C_T$ (maximum)$=1.80$. If the number of nozzles were increased to 4, $C_T$max will increase from 1.80 to 1.89. If N were 9, $C_T$max will increase to 1.93.

With regard to the design of the inlet portion 22 of counterthruster shroud 10 (section O–section I, FIG. 8), there are numerous ways in which to design suitably low loss inlet portions. Two such general schemes are illustrated in FIG. 8.

The principal features of the inlet portion 22 of shroud 10 in accordance with the present invention are a bellmouth section of length $L_1$ (FIG. 8), whose nose (forwardmost) diameter is $2r_o$, followed by a transition section $(L_2+K_3)$ where the cross-sectional area is reduced from $\pi(r_2^2-r_1^2)$ to $\pi(d^2/4-b^2)$ in a smooth monotonic way. One satisfactory construction is that shown approximately by the dashed line in FIG. 8, where the area varies linearly with $x/(L_1+L_2+L_3)$. Any smooth monotonic transition is acceptable when the area $\pi(r_o^2-r_1^2)$ is $>4\pi r_t^2$. That is, if the velocity in the sections $L_1$ and $L_2$ is sufficiently low, even a poorly designed bellmouth section $(L_1)$ and strut section $(L_2)$ have only a minor influence on the value of $k_L$, which is based on the velocity $\overline{V}_2^2$. However, the diver tool of the present invention must be relatively small, and thus the inlet portion 22 will preferably be designed so that the value of $k_L$ is small, at least for $(r_o^2-r_1^2)/r_t^2<4$.

An alternative design for inlet portion 22 is shown by the solid lines in FIG. 8. The principal advantage of this design is the simple constant diameter section $(L_2)$ which houses the support struts 13 that must be provided to connect the counterthruster shroud 10 to the pipe 11 supplying fluid to counterthruster nozzle 12. Support struts 13 must be adequately strong to withstand the rough handling to which such a diver tool is typically subjected. Since struts 13 must be immersed in the flow induced into and through the counterthruster shroud 10, they are a principal contributor to the pressure loss in the inlet portion 22 of counterthruster 20. This loss is substantially minimized if the cross-sectional area in which struts 13 are located is made larger than the cross-sectional area of the following counterthruster mixing tube 21 so that the velocity of the fluid passing by the struts is diminished. It is preferred that this velocity be lower along the entire length of struts 13. Therefore, in this embodiment of the invention, a constant diameter of $2r_2$ is maintained along the entire length of strut section $L_2$ (FIG. 8). Since support struts 13 contribute to the inlet loss, the minimum number required for strength should be utilized. The minimum number of struts 13 required to give adequate strength in all directions is 3. This is, therefore, the preferred number.

Referring to the notations in FIG. 8, the value of the pressure loss coefficient $(k_L)$, as defined previously, may be determined in a known manner for each of the inlet lengths $(L_1, L_2, L_3)$ comprising inlet portion 22 of shroud 10.

The details of the bellmouth inlet section $(L_1)$ are determined as a function of the values of $r_1$ and $r_2$ at the downstream end of this section, as well as the discharge selected. This section $(L_1)$ is very important to good performance and if it is designed so as to be substantially separation free, the loss associated with it is essentially skin friction. If the bellmouth section $(L_1)$ is poorly designed and separation occurs, an additional loss will result.

We have found that the preferred value of $r_o/r_2$ is about 1.3 to 1.4, with a still more preferred value being about 1.35. We have likewise found that the preferred value of $L_1/r_2$ is about 1.0 to 1.5, with a still more preferred value being about 1.3. An adequate bellmouth section design may be obtained by approximately matching the free streamline shape of an imagined orifice whose radius $r_o$ is 1.3 to 1.4 times $r_2$ and located 1 to 1.5 times $r_2$ upstream of the forward end of the strut section $(L_2)$, and connecting the edge of this imagined orifice with the strut section with a curve comprising a portion of an ellipse, as shown in FIG. 8. The free streamline shape for orifices is discussed, for example, in H. Rouse, *Engineering Hydraulics*, 1950, which disclosure is hereby incorporated herein by reference.

Figure 3:
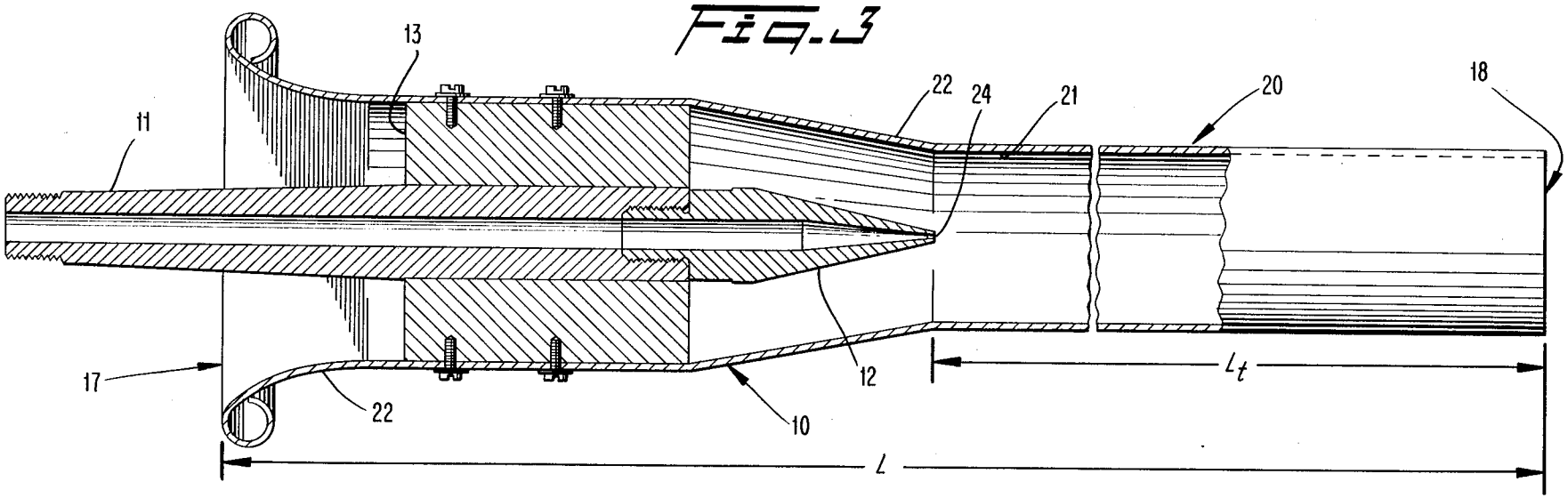
FIG. 3 is a cross-sectional side view of the shroud of one embodiment of the jet-pump counterthrusting device suitable for use in the tool shown in FIG. 1.

One suitable leading edge for the imagined orifice edge is a cylinder of radius 0.2 $r_2$ or greater. Any smooth approximation to this shape for inlet 17 will be satisfactory, resulting in the separation loss coefficient $(k_s)$ approaching O. FIG. 3 illustrates a fairing designed by this method.

If preferred values of $r_o/r_2=1.35$, $L_1/r_2=1.3$ are utilized, it can be shown that the pressure loss coefficient for the bellmouth section $(L_1)$ based on the velocity $\overline{V}_2$ may be written as $$k_{L1}\simeq\frac{k_s+3.2\,c_f r_2^2(r_t^4)}{(r_2^2-r_1^2)^3}=\frac{(k_s+3.2\,c_f)\left(\frac{r_t}{r_2}\right)^4}{\left[\left(1-\frac{r_1}{r_2}\right)^2\right]^3}$$

where $k_s$ is a separation loss coefficient based on the velocity $\overline{V}_1$.

Section $L_2$ (FIG. 8) houses struts 13 which connect counterthruster shroud 10 to the counterthrust jet supply pipe 11. In order to minimize the constriction caused by these struts and also to minimize their drag, the struts are preferably made as thin as practicable consistent with ease of fastening and adequate strength. Preferably the area obstructed by struts 13 is limited to approximately 10 percent. Thus, it can be shown that $$\frac{3t\,(r_2-r_1)}{\pi\,(r_2^2-r_1^2)}\leqq 0.1$$

where t=lateral thickness of struts 13. Likewise $$t_{max}\approx 0.11\,(r_1+r_2)$$

This restriction becomes unimportant if the diameter $d_2$ of inlet portion 22 is very large compared to the diameter $d_t$ of mixing tube 21. However, the diver tool of the present invention is preferably constructed as small and as light as possible, so that inlet diameter $d_2$ should be as small as required to achieve good performance.

The chord length of strut 13 is preferably 6 to 15 times, and more preferably 10 times, its thickness. The strut shape is preferably well streamlined (preferably as NACA foil section); however, a shape having a nose radius equal to t/2 and an afterbody wedge length equal to 2.5t to 4t is adequate.

The pressure loss for strut section $L_2$ is principally skin friction, particularly if the chord length is greater than 10t.

$L_2/t$ is preferably between about 6 and about 15, with the latter value providing very high structural rigidity and the former value providing lower, but still adequate, structural rigidity for most applications. If $L_2/t$ is assumed to be 15, it can be shown that:

$$k_{L2} = 0.12\, c_f\left(\frac{L_2}{t}\right)\left(1+\frac{r_1}{r_2}\right)\left(1.9-0.91\frac{r_1}{r_2}\right)\left[\frac{\left(\frac{r_t}{r_2}\right)^4}{\left[\left(1-\frac{r_1}{r_2}\right)^2\right]^3}\right]$$

Transition section ($L_3$) connects inlet portion 22 to mixing tube 21. The cross-sectional area of this section must vary monotonically and if its length is approximately equal to the diameter of the strut section ($L_2$), any shape that produces monotonic area change is adequate, provided the upstream and downstream slopes are zero or tangent to the strut section and mixing tube 21. FIG. 8 shows transition section ($L_3$) as conical with end fairing radii of 0.5 $r_t$.

In order to prevent separation over the afterbody of nozzle supply pipe 11, which would cause the loss in the transition section ($L_3$) to be greater than mere skin friction loss, the exterior of counterthrusting nozzle 12 is preferably tapered and faired as shown in FIG. 8. The length of the conical nozzle exterior fairing is preferably at least about two times the outer diameter $d_1$ of supply pipe 11, and the nozzle exterior preferably has a radius fairing at the juncture with supply pipe 11 of approximately 0.5 $r_2$.

The internal diameter $d_a$ of supply pipe 11 is preferably at least about 5 times the diameter of the jet, $d_j$, in order to substantially minimize supply losses.

The relationship between $d_1/d_a$, the operating pressure, P, and the working stress, $\sigma_w$, in the pipe metal is approximately $d_1/d_a \geqq 1+P/\sigma_w$. If P=10,000 psi and $\sigma_w$=10,000 psi, as it will in many applications of the invention, then $d_1/d_a$ must be at least about 2.

The nozzle orifice 24 exterior diameter, $d_b=2\ r_b$, preferably does not exceed three times the nozzle orifice 24 internal diameter, $d_j$=jet diameter, and preferably is as small as is structurally achievable and practical. This requirement is essential only in that it affects the requirement that $A_2 \approx A_3$, and failure to minimize $a_b/A_3$, will either reduce $C_T$ or cause an increase in the overall size of the tool in order to achieve a desired $C_T$.

It can be shown that:

$$k_{L3} = \frac{c_f}{2}\left\{\left(1+\frac{r_t}{r_2}\right)\left[4+\left(\frac{r_t}{r_2}-1\right)^2\right]^{\frac{1}{2}} + 2.23\pi\left(\frac{r_1}{r_2}\right)^2\right\}\frac{\left[1+\left(\frac{r_t}{r_2}\right)^2-\left(\frac{r_1}{r_2}\right)^2\right]}{\left[1-\left(\frac{r_1}{r_2}\right)^2\right]^2}$$

The total value of $k_L$, the pressure loss coefficient, for inlet portion 22 is $k_{L1}+k_{L2}+k_{L3}$.

In calculating $k_L$, the value of separation loss coefficient, $k_s$, may be taken as zero if the inlet bellmouth section $L_1$ is designed so that there is no flow separation anywhere along its length. However, the value of $k_s$ can approach 1.0 if, for example, no inlet bellmouth section is provided. Improperly designed bellmouths will result in values of $k_s$ that are large (e.g. several tenths) but less than 1. Such large values of $K_s$ can be tolerated if $r_2/r_t$ is large, but such large values of $r_2/r_t$ are generally impractical. For practical values of ($r_2/r_t$), the separation loss coefficient $k_s$ can greatly affect the value of $C_T$ achieved by counterthruster 20.

The foregoing analysis provides a method for estimating the performance of the jet pump counterthruster 20 of the present invention, as measured by the thrust augmentation ratio $C_T$. The actual dimensions of the tool of the invention are determined by the operating pressure and required counterthrust, the selection of the mixing tube 21 radius, $r_t$, and the selection of dimensions for inlet portion 22 of counterthruster 20 which provide acceptably low values of $k_L$ and $k_s$.

The above analysis demonstrates that the cross-sectional area of mixing tube 21 must be very much greater than the jet orifice 24 cross-sectional area. Since the overall dimensions of the tool will be reduced by selecting the value of $r_t/r_j$ as small as possible, the following discussion focuses on how small $r_t/r_j$ can be.

There are two constraints which determine the preferred value of $r_t/r_j$:

(1) $r_t/r_j$ must be large enough to allow the pressure at the upstream end of mixing tube 21 to remain above vapor pressure so as to prevent cavitation in the induced flow around the jet. Cavitation will almost always be present in the shear zone between the primary jet and the induced flow. However, if cavitation is also allowed to occur in the induced flow, the flow will tend to "choke" and the value of $C_T$ will rapidly decrease.

(2) If $r_t/r_j$ is not very much greater than 1, then the approximate equation defining $C_T$, as set forth previously, is not adequate, and a more expanded equation must be used to estimate the amount of performance reduction that will occur for decreases in $r_t/r_j$.

Generally, diver tool size will be fixed by the former constraint, i.e., the cavitation condition. This effect is discussed further below.

Noting that the incipient cavitation number $\sigma$ may be expressed as follows:

$$\sigma_i = \frac{P_o - P_1}{K_1 \frac{1}{2}\rho \bar{V}_1^2} = (1 + K_L)\frac{K_2}{K_1}\left(\frac{\bar{V}_2}{\bar{V}_1}\right)^2$$

where $P_o$ is the operating ambient pressure, it can be shown, using the continuity equation and various of the above equations, that the immediately preceding equation becomes:

$$\frac{A_1}{A_3} = \left(\frac{r_j}{r_t}\right)^2 = \left(\frac{\sigma_i}{2}\right)\left(1 + \frac{4c_f\frac{L}{d}}{1 + k_L}\right)\left(\frac{K_3}{K_2}\right)$$

Then, using the condition $A_1/A_3 << 1$, as discussed previously, and noting that Operating Cavitation Number, $$\delta_i = \frac{P_o - P_V}{\Delta P}$$

where $P_V$ is the water vapor pressure and $\Delta P$ is the operating pressure across the nozzle orifice, and assuming that the value of $P_1$ (see FIG. 9 and the previous discussion) is the water vapor pressure, $P_v$, and that $4\,c_f L_t/d_t = 0.11$ and $k_L = 0.2$, approximately, it follows that:

$$\frac{r_t}{r_j} \simeq 1.35\sqrt{\frac{\Delta P}{P_o - P_v}}$$

Because cavitation that exists in the shear zone constricts the mixing regions in mixing tube 21 to some unknown degree, we have found that $r_t/r_j$ should preferably be increased about 20 percent to provide a safety margin against cavitation choking of the induced flow in mixing tube 21. Thus, it can be shown that the scale of a preferred diver tool ($C_T \approx 1.7$) in accordance with the present invention is determined by the approximate relation $$\left(\frac{r_t}{r_j}\right) \simeq 1.62\sqrt{\frac{\Delta P}{P_o - P_v}} \simeq \frac{1.62}{\sqrt{\sigma_o}}$$

EXAMPLE

The following typical diver tool requirements and operating conditions are assumed, at least as first approximations for calculation purposes, in this example:

$\Delta P = 10{,}000$ pounds per square inch (absolute).

$P_o$ (the pressure near the surface) chosen such that $P_o - P_v = 14$ pounds per square inch (absolute).

$Q_e$ (erosive jet) $+ Q_c$ (counterthrust jet) $= Q_t = 20$ gallons per minute. That is, 20 gallons per minute are available to be distributed between the erosive jet and the counterthrust jet.

$C_{De}$ (discharge coefficient of erosive nozzle) $= 0.57$.

$C_{Dc}$ (discharge coefficient of counterthrust nozzle) $= 1.0$.

Initially estimate $L_t = 2$ ft. $\bar{V}_2$ (FIG. 8) as approximately 50 feet per second, and $R_e = 10^7$; therefore $c_f \approx 0.003$, and $4\,c_f L_t/d_t = 0.11$.

Initially assume $k_L = 0.11$; then initially approximate $C_T = 1.63$.

$\Sigma_o$ (the operating cavitation number in counterthruster 20 at section I—FIG. 8) $= (\rho_o - \rho_v)/\Delta_p = 14 \times 10^{-4}$ From the above assumptions and selected first approximations, it can be shown that:

Diameter of erosive jet nozzle orifice $= 0.085$ inch;

Diameter of counterthrusting jet nozzle orifice ($d_j$, FIG. 8) $= 0.05$ inch, and $r_j = 0.025$ inch;

Diameter of mixing tube ($d_t$, FIG. 8) $\approx 2.0$ inches.

For Qt = 20 gallons per minute nominal, ¾ in. pipe with an outside diameter of about 1 in. is selected (for purposes of this example) to feed both nozzles 4 and 12 (FIG. 1). Thus, $r_1 = 0.5$ inch and $r_a = 0.375$ inch.

The axial length of the strut support section ($L_2$, FIG. 8) is selected at 15 times the lateral thickness of the struts (t, FIG. 8), which is conservative and will permit high structural rigidity. Values of $L_2$ as low as 6t are contemplated.

Figure 11:
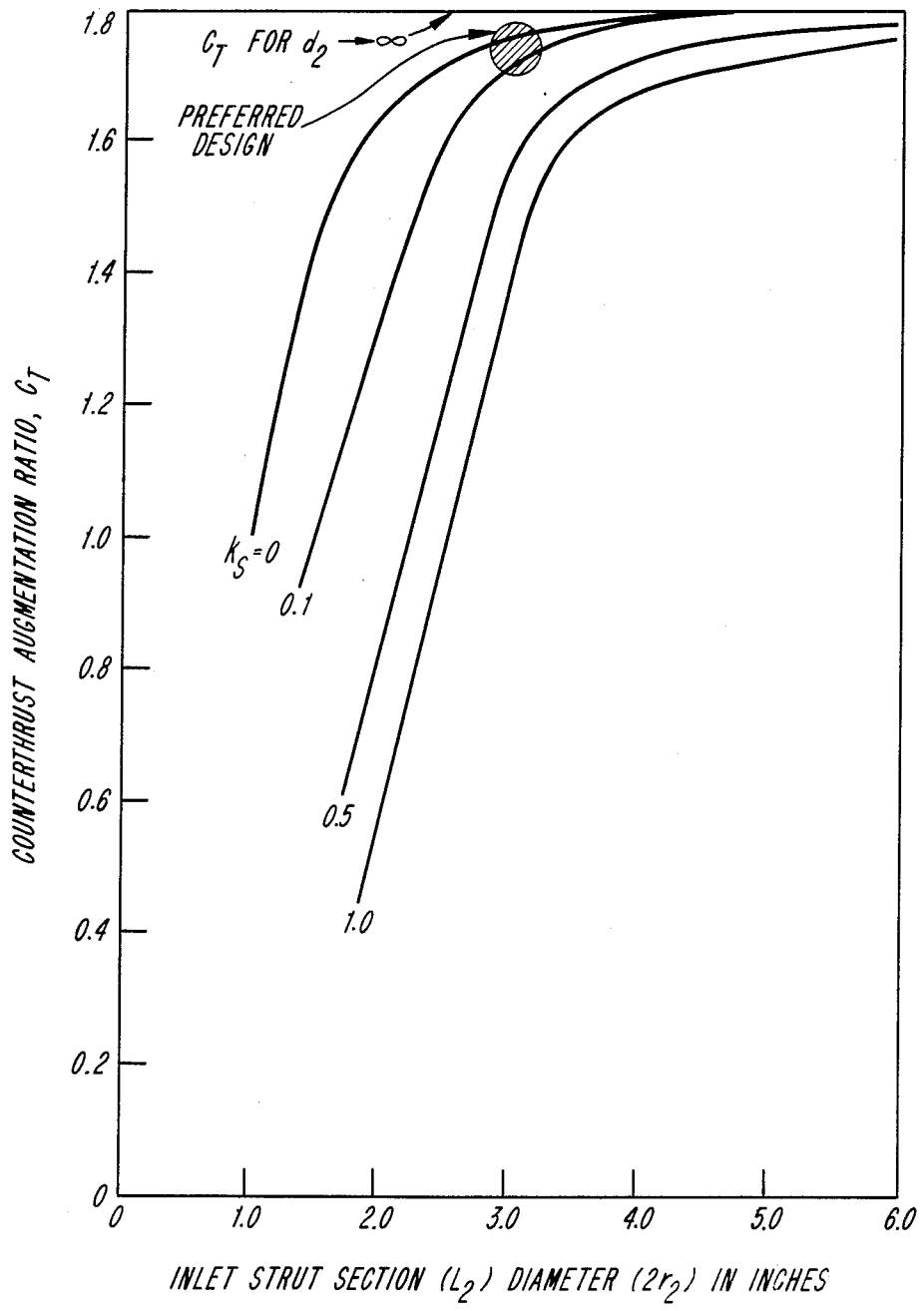
FIG. 11 presents the results of calculated values of the thrust augmentation ratio $C_T$ as influenced by the inlet diameter and inlet superation loss coefficient for a counterthrust mixing tube diameter of 2 inches and orifice supply pipe outside diameter of 1 inch.

Based on the above assumptions and selected first approximations, values of $C_T$ were calculated in reference to variations in the diameter ($2r_2$, FIG. 8) of the strut support section ($L_2$, FIG. 8) of the shroud 10 for selected values of the separation loss coefficient, $k_s$. These values of $C_T$ are plotted in FIG. 11. FIG. 11 shows that the value of $r_2$ is preferably selected at about 1.5 inches (in the shaded region), so as to avoid sensitivity to inlet drag, i.e., to maintain $k_s$ at substantially zero. Moreover, the minor gains in performance shown in FIG. 11 for values of $r_2$ greater than 1.5 inches do not make such values more preferable, since such minor gains do not justify the added weight and increased size of the tool necessitated by larger values of $r_2$. For the example, $r_2$ is selected at 1.5 inches.

Selecting a conservative values of 0.1 for $k_s$ in a tool constructed in accordance with this example, the following actual values can be calculated for such a tool: $k_L = 0.053$ and $C_T = 1.72$.

The invention in its broader aspects is not limited to the specific details shown and described, and departures may be made from such details without departing from the scope of the present invention and without sacrificing its chief advantages.

What is claimed is:

1. An erosive fluid jet tool for underwater operation, comprising:

(a) means for receiving a fluid under elevated pressure for providing hydraulic power to the tool;

(b) erosive fluid jet nozzle means connected to the fluid receiving means for providing the working output jet of the tool; and (c) means for providing a counterthrusting force for balancing the thrust on the tool produced by the erosive fluid jet, the counterthrusting means including a counterthrusting fluid jet nozzle connected to the fluid receiving means and facing oppositely to the erosive nozzle means for providing a counterthrusting jet and open ended shroud means coaxially surrounding the counterthrusting jet nozzle, said shroud means including a mixing tube for substantially coaxially surrounding said counterthrusting jet, wherein the value of the ratio $r_t/r_j$, the effective cross-sectional radius of said mixing tube, $r_t$, to the effective cross-sectional radius of said counterthrusting jet nozzle, $r_j$, is sufficiently large to permit the pressure within said mixing tube at the upstream end of said counterthrusting jet to remain above the vapor pressure during operation, said value being at least about $1.62/\sqrt{\Sigma_o}$, where $\Sigma_o$ is the operating cavitation number, whereby, during operation, water surrounding the submerged tool is entrained through the shroud means for providing additional counterthrusting force during operation of the counterthrusting means, the erosive fluid jet nozzle means and the counterthrusting means being constructed so that in excess of 50% of the hydraulic power provided to the tool is provided to the erosive fluid jet nozzle means and whereby, during operation, cavitation is substantially prevented from occurring in the entrained flow around said counterthrusting jet within said mixing tube.

2. A tool as claimed in claim 1, wherein the inlet contour and internal shape of the shroud means are selected to substantially reduce losses in the flow of water entrained through the shroud means.

3. A tool as claimed in claim 1 or 2, wherein the counterthrusting fluid jet nozzle includes a supply pipe connected to the fluid receiving means and an outlet orifice connected to the supply pipe, and wherein the outside contours of the supply pipe and the outlet orifice are selected to substantially reduce losses in the flow of water entrained through the shroud means.

4. A tool as claimed in claim 1, wherein the counterthrusting means are constructed so as to achieve a thrust augmentation ratio value greater than 1.0, the thrust augmentation ratio being defined as the ratio of the total thrusting force developed by the counterthrusting means to the thrust developed by the counter thrusting nozzle in the absence of the shroud means.

5. A tool as claimed in claim 4, wherein the counterthrusting means are constructed so as to achieve a thrust augmentation ratio value of about 1.7.

6. A tool as claimed in claim 1, wherein the erosive fluid jet nozzle means is constructed so as to enhance the creation of cavitation in and around the working output jet issuing therefrom during operation.

7. A tool as claimed in claim 6, wherein the erosive fluid jet nozzle means is constructed so as to provide passive fluctuation of the velocity of the working output jet issuing therefrom during operation for further enhancing the creation of cavitation.

8. A tool as claimed in claim 1, wherein the counterthrusting fluid jet nozzle includes a substantially cylindrical supply pipe connected to the fluid receiving means and a substantially circular outlet orifice connected to the supply pipe.

9. A tool as claimed in claim 8, wherein the value of the ratio, $L_t/d_t$, the length of the mixing tube, $L_t$, to the internal diameter of the mixing tube, $d_t$, is greater than about 6 and less than about 15.

10. A tool is claimed in claim 9, wherein the value of the ratio $L_t/d_t$ is about 9.

11. A tool as claimed in claim 8, wherein the internal diameter of the supply pipe is at least about 5 times the internal diameter of the outlet orifice.

12. A tool as claimed in claim 11, wherein the internal diameter of the supply pipe is about 7.5 times the internal diameter of the outlet orifice.

13. A tool as claimed in claim 8, wherein the supply pipe is constructed of metal and the external diameter of the supply pipe is not less than the value of the internal diameter of the supply pipe multiplied by the following expression: $1+P/\Sigma_w$, where P is the operating pressure and $\Sigma_w$ is the working stress in the supply pipe metal.

14. A tool as claimed in claim 13, wherein the internal diameter of the supply pipe is about 3 times the internal diameter of the outlet orifice.

15. A tool as claimed in claim 8, wherein the external portion of the supply pipe immediately upstream of the outlet orifice is conically faired, with the length of the fairing being greater than about 4 times the external radius of the supply pipe.

16. A tool as claimed in claim 15, wherein the length of the fairing is about 5 times the external radius of the supply pipe.

17. A tool as claimed in claim 8, wherein, at the face of the outlet orifice, the external radius of the outlet orifice, $r_b$, is no greater than about 5 times the internal radius of the outlet orifice.

18. A tool as claimed in claim 8, wherein, at the face of the outlet orifice, the external radius of the outlet orifice, $r_b$, is about 2 times the internal radius of the outlet orifice.

19. A tool as claimed in claim 8, further comprising 3 streamlined, air foil-shaped struts secured longitudinally along the supply pipe supporting the shroud means, the struts being angularly spaced apart around the periphery of the supply pipe at intervals of 120 degrees.

20. A tool as claimed in claim 19, wherein the shroud means includes a substantially cylindrical support section in the region of the struts, and wherein the lateral thickness of each strut, viewed from the erosive nozzle means, does not exceed between about 0.05 and about 0.2 times the sum of the external radius of the supply pipe and the internal radius of the cylindrical support section.

21. A tool as claimed in claim 20, wherein the lateral thickness of each strut does not exceed about 0.1 times the sum of the external radius of the supply pipe and the internal radius of the cylindrical support section.

22. A tool as claimed in claim 20, wherein the longitudinal length of the cylindrical support section does not exceed about 13 times the lateral thickness of the struts.

23. A tool as claimed in claim 20, wherein the difference between the cross-sectional area of the support section and the external cross-section area of the supply pipe equals at least the cross-sectional area of the mixing tube.

24. A tool as claimed in claim 20, wherein the difference between the cross-sectional area of the support section and the external cross-sectional area of the supply pipe equals at least 2 times the cross-sectional area of the mixing tube.

25. A tool as claimed in claim 19, wherein the longitudinal length of the struts does not exceed between about 6 and about 15 times the lateral thickness of the struts.

26. A tool as claimed in claim 19, wherein the lateral thickness of each strut, viewed from the erosive nozzle means, is about ¼ inch.

27. A tool as claimed in claim 8, wherein the shroud means includes a substantially cylindrical support section and an intermediate tube entrance section between the support section and the mixing tube for connecting the support section to the smaller diameter mixing tube, the axial length of the tube entrance section being between about 0.25 and about 3 times the diameter of the support section.

28. A tool as claimed in claim 27, wherein the axial length of the tube entrance section is substantially equal to the diameter of the support section.

29. A tool as claimed in claim 27, wherein the cross-sectional area of the tube entrance section varies monotonically over its length.

30. A tool as claimed in claim 29, wherein the tube entrance section is frustoconically shaped with entrance and exit fairing radii between about 2.5 and about 1.0 times the radius of the mixing tube.

31. A tool as claimed in claim 30, wherein the entrance and exit fairing radii are about 5 times the radius of the mixing tube.

32. A tool as claimed in claim 8, wherein the shroud means includes a bellmouth section at its upstream end and a substantially cylindrical support section following the bellmouth section, th bellmouth section having an inlet fairing radius of at least about 0.05 times the radius of the support section.

33. A tool as claimed in claim 32, wherein the bellmouth section possesses an upstream inlet fairing radius of about 0.2 times the radius of the support section.

34. A tool as claimed in claim 32, wherein the upstream end of the bellmouth section includes a portion conforming to a section of an ellipse and the axial length of the bellmouth section is between about 1.0 and 1.5 times the radius of the support section.

35. A tool as claimed in claim 34, wherein the radius of the bellmouth section at the upstream end of said portion is about 1.3 to 1.4 times the radius of the support section, the major axis of said ellipse is about 1.3 times the length of the radius of the support section and the minor axis of said ellipse is about 0.35 times the length of the radius of the support section.

36. A tool as claimed in claim 8, wherein the counterthrusting nozzle and the shroud means are sized and shaped such that the pressure loss coefficient is between about 0.05 and 0.3 and the length of the mixing tube is about 9 times its diameter.

37. A tool as claimed in claim 1, wherein the counterthrusting fluid jet nozzle includes a substantially cylindrical supply pipe connected to the fluid receiving means and a plurality of outlet orifices connected to the supply pipe, and wherein the mixing tube is coaxially aligned with the axis of the supply pipe and extends downstream from the outlet orifices, in relation to the direction of flow through the outlet orifices.

38. A tool as claimed in claim 37, having 4 outlet orifices, each of the outlet orifices being situated at the centroid of one of 4 equal segments of the cross sectional area of the mixing tube at its upstream end.

39. A tool as claimed in claim 1, wherein the shroud means includes a bellmouth inlet section extending from its upstream terminal end to the exit plane of the counterthrusting nozzle, the bellmouth section being sized and shaped so as to be substantially separation free with respect to the through flow.

40. A method for providing a counterthrusting force for balancing the thrust on an underwater, erosive, fluid jet tool supplied from a hydraulic fluid power source, the thrust being produced by the erosive fluid jet emanating from the tool, comprising:

providing the toll with a counterthrusting fluid jet supplied from said hydraulic fluid power source and emitting the counterthrusting fluid jet from the tool through a counterthrusting jet nozzle in a direction opposite to the erosive fluid jet;

providing the tool with an open ended shroud means coaxially surrounding the counterthrusting jet, said shroud means including a mixing tube substantially coaxially surrounding said counterthrusting jet, wherein the value of the ratio $r_t/r_j$, the effective cross-sectional radius of said mixing tube, $r_t$, to the effective cross-sectional radius of said counterthrusting jet nozzle, $r_j$, is sufficiently large to permit the pressure within said mixing tube at the upstream end of said counterthrusting jet to remain above the vapor pressure, said value being at least about $1.62/\sqrt{\Sigma_o}$, where $\Sigma_o$ is the operating cavitation number, and entraining water surrounding the submerged tool through the shroud to provide a counterthrusting force in addition to the force of the counterthrusting fluid jet, whereby cavitation is substantially prevented from occurring in the entrained flow around said counterthrusting jet within said mixing tube; and supplying in excess of 50% of the total hydraulic power supplied to the tool to the erosive fluid jet.

* * * * *